United States Patent [19]

Freiborg

[11] 4,404,783

[45] Sep. 20, 1983

[54] MULTI PURPOSE ROOF PIECE

[76] Inventor: Bennie Freiborg, 4536 Indiana Ave., La Canada, Calif. 91011

[21] Appl. No.: 207,357

[22] Filed: Nov. 17, 1980

[51] Int. Cl.[3] ..... E04D 1/20

[52] U.S. Cl. ..... 52/518; 52/98; 52/523; 52/528; 52/530

[58] Field of Search ..... 52/98, 100, 105, 518, 52/529, 530, 528, 523, 526, 525, 524, 559, 540

[56] References Cited

U.S. PATENT DOCUMENTS

| | | | |
|---|---|---|---|
| 420,707 | 2/1890 | Toner et al. . | |
| 1,435,623 | 11/1922 | Saxe | 52/528 |
| 1,471,396 | 10/1923 | Griswold . | |
| 1,596,272 | 8/1926 | Jordan . | |
| 1,698,891 | 1/1929 | Overbury | 52/559 |
| 2,013,330 | 9/1935 | Abraham | 52/528 |
| 2,192,810 | 3/1940 | Angier . | |
| 2,305,008 | 12/1942 | Howard . | |
| 2,429,480 | 10/1947 | Miller . | |
| 2,538,206 | 1/1951 | Mabie, Sr. et al. | 52/523 |
| 2,667,131 | 1/1954 | Clarvoe . | |
| 3,564,785 | 2/1971 | Kephart, Jr. . | |
| 3,913,292 | 10/1975 | Freiborg . | |
| 4,226,069 | 10/1980 | Hinds | 52/528 |
| 4,322,928 | 4/1982 | Freiborg | 52/540 |

FOREIGN PATENT DOCUMENTS

| | | | |
|---|---|---|---|
| 598254 | 5/1960 | Canada | 52/530 |

*Primary Examiner*—John E. Murtagh
*Assistant Examiner*—Richard E. Chilcot, Jr.
*Attorney, Agent, or Firm*—Blakely, Sokoloff, Taylor & Zafman

[57] ABSTRACT

An asphalt composition roofing piece having a unique geometry and simplicity of form which enables such piece to be used as a starter piece, edge covering rake covering, and ridge or hip cover.

7 Claims, 8 Drawing Figures

Fig. 3
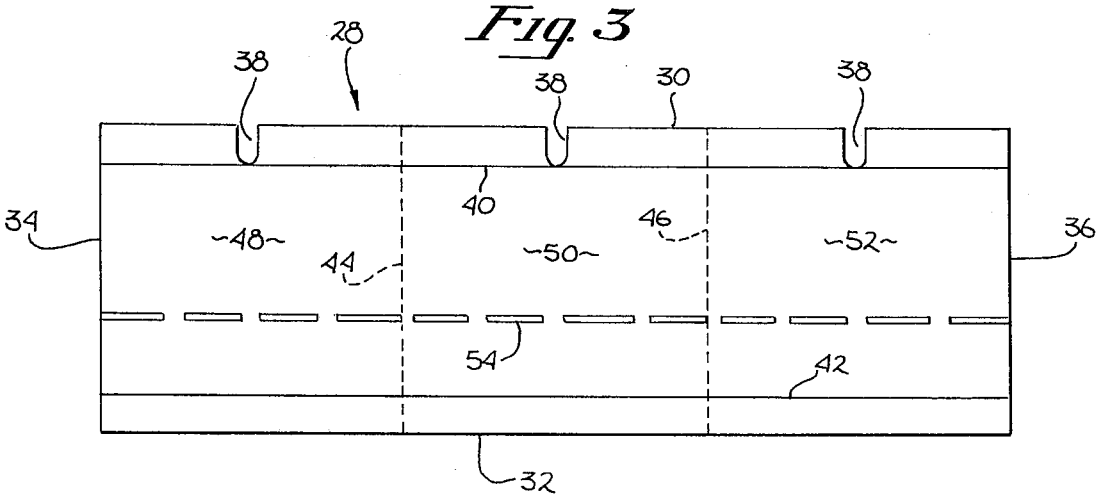
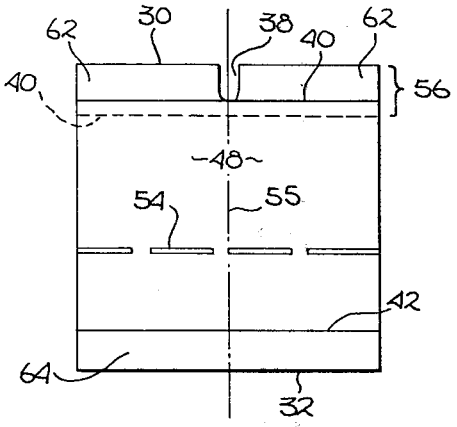
Fig. 4
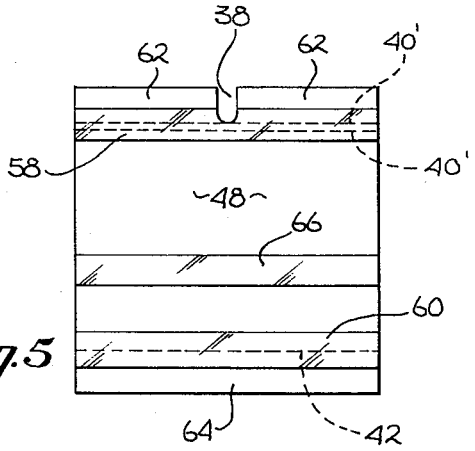
Fig. 5
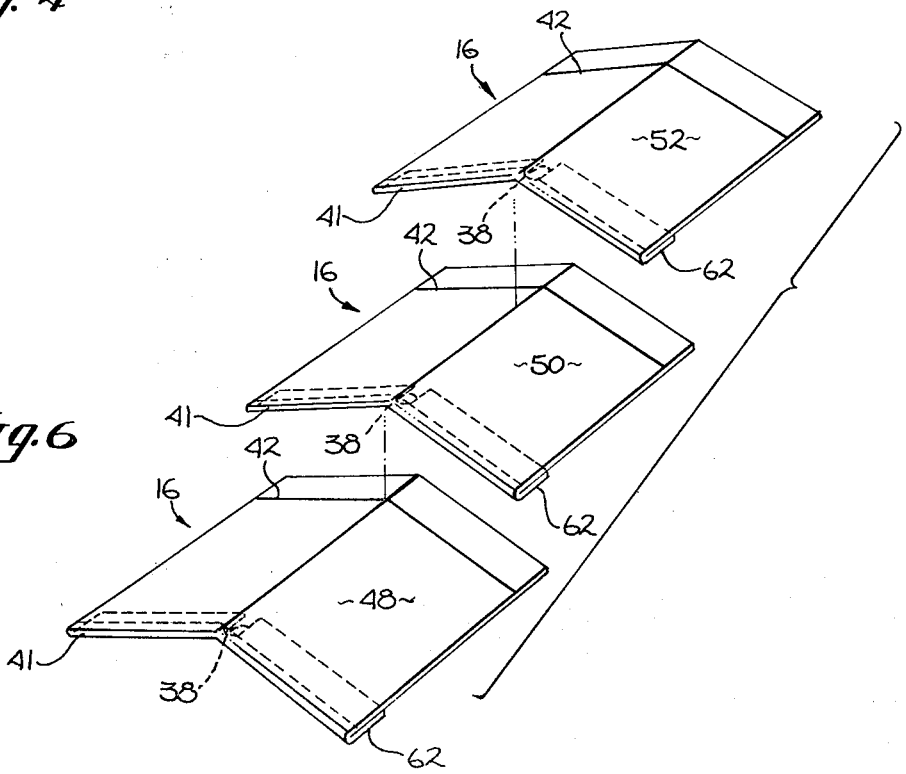
Fig. 6

MULTI PURPOSE ROOF PIECE

SUMMARY OF THE INVENTION

An asphalt composition roofing piece having an overall size identical to that of conventional asphalt composition shingles commonly produced today. Such shingles are approximately 12 inches wide and 36 inches long and are cut from rolls of asphalt composition material 36 inches wide. Thus, three such 12 inch wide shingles may be cut from the 36 inch wide rolls. The roofing piece of the present invention is provided with precreased fold lines, a set of notches and a pair of perforations which permit it to be broken along the perforations into three identical 12 inch by 12 inch pieces. The 12 inch by 12 inch pieces may be used as rake pieces, or as hip and ridge covers by appropriate folding. The 36 inch by 12 inch piece may be used as starter pieces or as edge covers, the latter requiring a single fold.

To permit folding to occur without breaking the roofing piece along the fold lines, a fabric tape is adhered to the underside of the asphalt composition roofing piece. Alternatively, the fabric tape may be provided as an integral part of the underlying felt sheet during the fabrication of the felt sheet. To permit easy bending of the 12 inch by 12 inch piece when used as hip or ridge covers, a notch is placed along the bending line so that the bending only bends a single thickness of the asphalt composition material.

DESCRIPTION OF THE FIGURES

FIG. 3 shows the asphalt composition roofing piece of the present invention.

FIG. 4 shows the top surface of a section of the piece of FIG. 3.

FIG. 5 shows the bottom surface of a section of the piece of FIG. 3.

FIG. 6 shows the section of FIG. 4 folded to function as a hip or ridge cover.

DETAILED DESCRIPTION OF THE INVENTION

Figure 1:
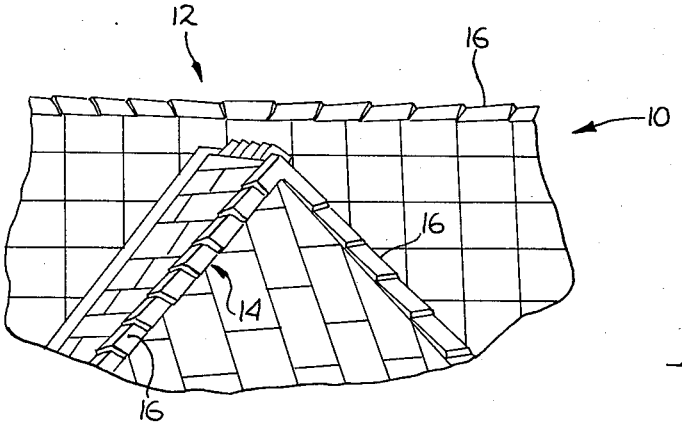
FIG. 1 shows a ridge and a hip portion of a conventional roof.

First referring to FIG. 1 there are shown portions of a typical roof 10 referred to as a ridge 12 and a hip 14. Both the ridge 12 and the hip 14 are shown as being covered by a hip or ridge cover 16 according to the present invention.

Figure 2:
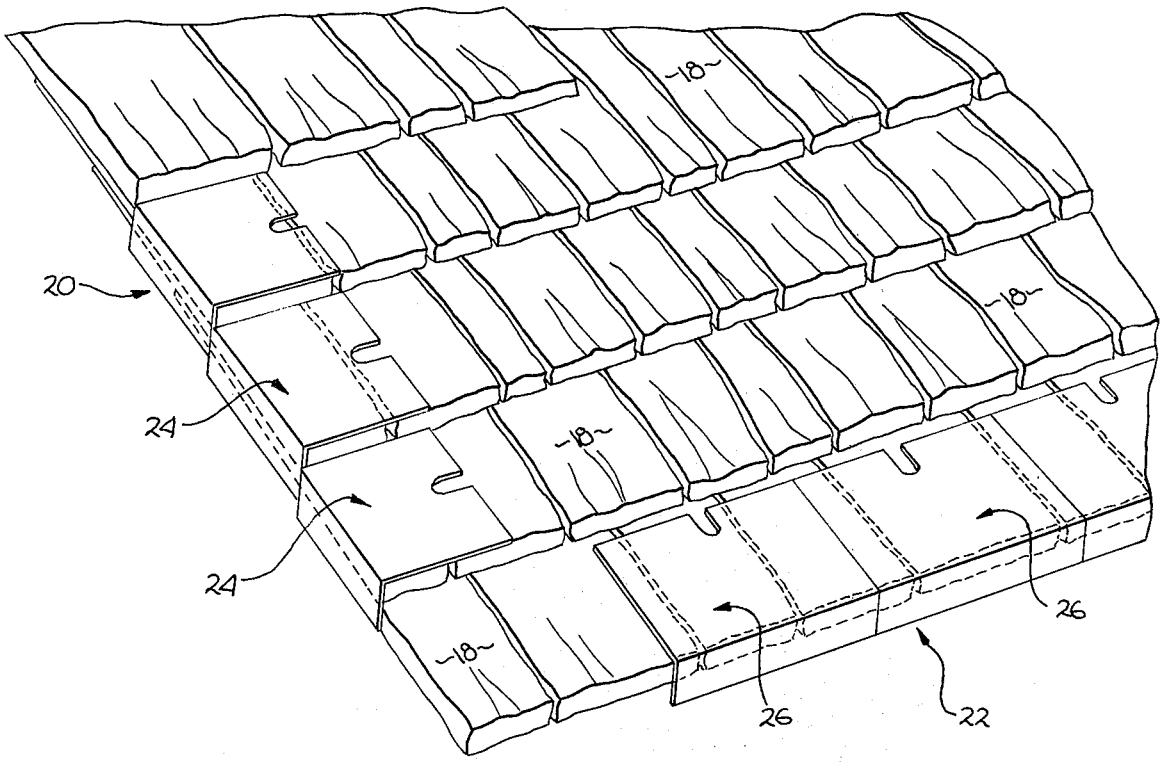
FIG. 2 shows a portion of a rake and edge of a conventional roof.

In FIG. 2 there is shown another section of a roof, that is, a typical corner of a roof covered with a plurality of wood shake shingles 18. Such a corner of a roof has a rake designated as 20 and a front edge designated 22. The rake 20 is shown covered by rake covers 24 formed according to the present invention. The front edge 22 is shown covered by edge coverings 26 also formed according to the present invention. Each of the above elements, that is the hip cover and the ridge cover 16, the rake cover 24 and the edge cover 26 are all formed from a single piece which will be referred to herein as the roofing piece 28 more fully illustrated in FIG. 3.

The roofing piece 28 as shown in FIG. 3 has what will be referred to as a first edge 30, a second edge 32, a first end 34 and a second end 36. The roofing piece 28 is provided with a plurality of notches 38 spaced evenly along the first edge 30. The notches are of equal depth, and along a line coincident with the bottom of the plurality of notches 38, there is provided a first fold line 40, which may be in the form of a crease. Such a crease or fold line 40 may be provided by running the roofing piece 28, during its manufacturing stage, beneath a narrow roller, not shown, which slightly creases the surface of the roofing piece 28 defining the fold line 40. A second fold line 42 formed in a manner similar to the formation of the first fold line 40 is provided a short distance from the second edge 32. The second fold line 42 is parallel to the first edge and extends the full length of the roofing piece 28, that is, it extends from the first end 34 to the second end 36. The roofing piece 28 is divided into three equally sized portions by a first perforation line 44 and a second perforation line 46 which run perpendicular to the length of the roofing piece 28 and therefore also run perpendicular to the first fold line 40 and to the second fold line 42. These perforations therefore define the extent of three smaller roofing pieces, the first roofing piece 48, the second roofing piece 50, and the third roofing piece 52. Each of these three smaller roofing pieces are identical in every respect.

The roofing piece 28 as shown in FIG. 3 is typically approximately 36 inches in length and 12 inches in width. Such a piece may therefore conveniently be cut from a roll of asphalt composition material which has a width of 36 inches and a length determined by the size of the roll of material. Thus, it can easily be seen that three such 12 inch wide roofing pieces 28 may be cut from the 36 inch width of the length of asphalt composition material. Each of the roofing pieces 28 so cut would have its length parallel to the length of the roll of composition material. Typical dimensions are: the first fold line 40 is provided at a distance approximately two inches from the first edge 30; the second fold line 42 is placed at approximately one and a half to three inches from the second edge 32, and, as shown in the FIG. 3, is approximately two inches from the second edge 32. The perforations define three equally sized roofing pieces approximately 12 inches square. The first fold line 40 and second fold line 42 are provided during the manufacturing process of the roofing piece 28 and as previously mentioned are formed by causing a narrow roller to roll along the length of the roofing piece 28 and therefore define a crease in the surface of the roofing piece 28.

During the manufacturing stage of a roofing piece 28 there is applied to the granular surface of the asphalt composition roofing piece 28 a strip of adhesive material designated 54 in FIG. 3. When these individual small roofing pieces, that is first piece 48, second piece 50 and third piece 52, are used as either hip or ridge covers, the strip of adhesive 54 insures that the hip or ridge cover, overlying the hip or ridge cover which has the adhesive on it, sticks to the underlying hip or ridge cover at the front edge of the overlying hip or ridge cover so that the wind does not raise the front edge of the overlying hip or ridge cover. The adhesive 54 also serves as a sealant to somewhat prevent driven rain from entering underneath the ridge and hip covers 16.

The roofing piece 28 may be broken along perforations 44 and 46 to provide the three small roofing pieces one of which is illustrated in greater detail in FIG. 4. The first edge 30 is provided with a notch 38 which extends to meet the first folding line 40. The second folding line 42 is provided parallel to the second edge 32 as is the strip of adhesive 54. The area between the first folding line 40 and the first edge 30 may be referred to as a first foldable portion 62. The area between the second folding line 42 and the second edge 32 may be referred to as a second foldable portion 64. In addition the roofing piece 48 may be viewed as having a longitudinal center line 55 running perpendicular to the first edge 30 and the second edge 32 and running through the center of notch 38. For purposes of aesthetics, to be more fully explained below, the individual small roofing pieces such as 48 may be provided with an area 56 of granules which are darker in color than the granules appearing on the top surface of the remainder of the roofing piece 48. This darker granular area 56 is indicated by the darker stipling within area 56 as shown in FIG. 4.

The underside of the roofing piece 48 is illustrated in FIG. 5. A first hinge means such as fabric tape 58 is located on the underside of the roofing piece 48 and exactly opposite the first folding line 40. A second hinge means such as fabric tape 60 is similarly disposed with respect to the second folding line 42. These fabric tapes 58 and 60 serve as a hinge means to permit the first foldable portions 62 and the second foldable portion 64 to fold and pivot about the first fold line 40 and the second fold line 42 respectively without causing the foldable portions 62 and 64 to separate from the main body of the roofing piece 48. These hinge means may be fabricated as an integral part of the raw felt sheet typically used to form asphalt composition material. It is of course contemplated that the first folding line 40 and the second folding line 42 or either of them could be applied to the underside of the roofing piece 48, that is, could be applied to the same side of the roofing piece 48 to which the first fabric tape 58 and the second fabric tape 60 are applied. In addition, it is further contemplated that either fold line 40 or fold line 42 could in reality be composed of two closely spaced fold lines that is, instead of a single fold line 40 there would be two parallel lines 40' extending the width of the roofing piece 48 and separated by approximately $\frac{1}{8}$ to $\frac{1}{4}$ of an inch. With such a double fold line the fold produces a smoother and more uniform appearance on the outside edge of the fold thus improving the aesthetics of the folded roofing piece 48 when used in either the hip and ridge mode or in the mode of a folded front edge cover 26 (to be further discussed below).

As shown in FIG. 5 there is also provided to the underside of the roofing piece 48 a non stick tape 66. This tape is applied directly opposite the adhesive 54 which is applied to the granule side of the roofing piece 48. The use of this tape 66 allows a plurality of roofing pieces 48, each having applied thereon a strip of adhesive 54, to be packed in the same carton in an opposed facing relationship such that the adhesive of one piece is opposed and facing the non stick tape 66 of a second roofing piece 48. Thus, the two roofing pieces 48 may be easily unpacked and separated as the adhesive 54 will not stick firmly to the tape 66.

FIG. 6 illustrates the manner in which a roofing piece 48 may be folded to serve as either a hip or ridge cover 16. Specifically the first foldable portion 62 is folded about fold line 40 such that the foldable portion 62 is folded underneath the main body portion of the roofing piece 48. This results in formation of the hip or ridge covers 16 as shown in FIG. 6. It should be noted that the majority of the area 56 of darkened granules has been folded underneath the forward edge 41 of the hip or ridge cover 16. This leaves a very narrow strip of darkened granules on the forward end of the hip or ridge cover 16. This darkened portion serves to provide a shadow effect to the ridge or hip cover 16 when installed on a roof. This increases the apparent thickness of the forward edge 41 of the hip or ridge cover 16 by giving the illusion to an observer that there is a shadow present on the forward edge of the hip or ridge cover. This gives the illusion of depth. As shown in FIG. 6 the notch 38 has been folded underneath the hip or ridge cover 16. Thus, only one thickness of the asphalt composition material is required to be bent when the hip or ridge cover 16 is folded along the longitudinal center line 55 to provide the ridge shape which allows the hip or ridge cover 16 to be properly seated upon a hip 14 or ridge 12 as shown in FIG. 1. It should be noted that when the roofing piece 48 is folded so as to function as a hip or ridge cover 16 the second folding line 42 can serve double duty and function as a weep line to direct moisture, which may have crept under the overlying hip or ridge cover, down the weep line to the roof shingles therebelow. This prohibits moisture from traveling up the full length of a hip or ridge cover 16 and going over the back edge 32 thereby gaining access to the bare roof surface beneath the shingles.

Figure 7:
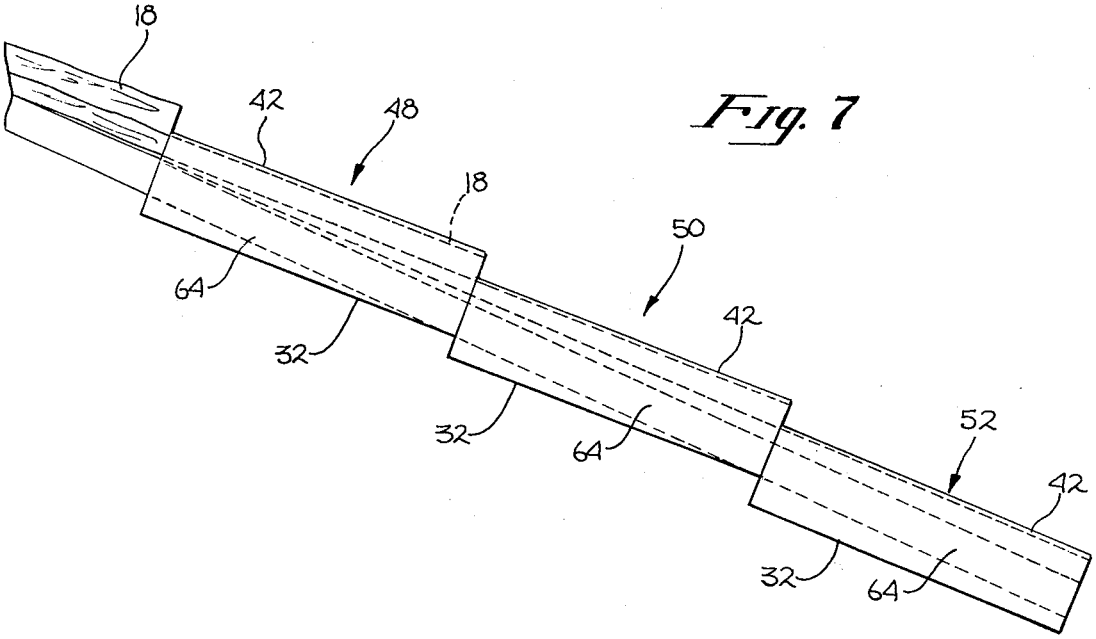
FIG. 7 shows the section of FIG. 4 folded to function as a rake cover.

The roofing piece 48 may also be folded so as to function as a rake cover 24 as more fully shown in FIG. 7. By folding the roofing piece 48 along the second fold line 42, the second foldable portion 64 lies at approximately a right angle to the main body portion of the roof piece 48. The individual roofing pieces 48 (or 50 and 52) may be laid along the edge of a wood shingle roof as clearly shown in FIGS. 2 and 7. It should be noted that the distance separating the second fold line 42 from the second edge 32 is sufficient to form a second foldable portion 64 of such a size as to completely cover the exposed edge of the underlying old wood shake shingle roof.

The advantages of such a rake shingle 24 are apparent when one considers the methods previously employed to cover the exposed edges of the old wood shingle roofs when re-roofing was performed. Re-roofing is the term applied to the procedure of placing a new roof directly over and covering an old roof. Thus, if a house is presently covered by a wood shingle roof and it is desired to put a new roof on the house alternate procedures are available. The old roof can be ripped off and a new roof applied or a new roof may be laid directly on top of the old roof. In a re-roofing procedure where a new roof is laid directly on top of the old roof it is undesirable for the edge of the old wood shingle roof to be visible. To this end the asphalt composition shingle of the present invention provides for the second foldable portion 64 to be foldable about the second fold line 42 so that it may hang over the rake of a roof when properly installed and thus cover the exposed edges of the old wood shingles. The proper installation method is shown in FIG. 2 with the main body of the roofing piece 48 laying flat over the greater exposed area of the wood shingles and the second foldable portion 64 hanging perpendicular thereto over the edge of the rake 20.

The most common way of previously hiding the exposed rake 20 or edge 22 in a re-roofing job was to use lengths of angled metal such as galvanized metal or pre-painted metal stripping of rather thin gauge and nailing the strips of metal along the length of the rake 20. Many disadvantages to such a system are readily apparent. First the metal had to be of relatively thin gauge so that a nail could readily pierce the thin gauge metal and secure the metal to the roof. Secondly, the typical such piece of metal was so thin that a roofer was easily cut in the event that he came in contact with edges of such a piece of metal. A further disadvantage is that such pieces of metal are either typically not painted and therefore are not aesthetically pleasing in that their surface is shiny and metalic and does not conform to the other surfaces in the immediate vicinity, or if the metal is painted its color is not easily made to match that of any other portion of the house unless it is separately painted along with the painting of the remainder of the trim of the house. Such additional effort is undesirable. By use of the present invention a rake covering 24 is supplied which can be formed at the same time as the manufacture of the shingles which are used to constitute the roof of the house. The rake cover 24 and the shingles will thus have virtually the same color. This is a substantial advantage over prior methods such as the use of long strips of thin gauge metal.

Another disadvantage of the thin gauge metal stripping was that if used in a re-roof job the surface, on which the metal stripping is applied, is not level. The wood shingles produce a surface which is discontinuous. When a metal strip is nailed to such a discontinuous (not level) surface, the metal tends to wrinkle and produce waves which produce an undesirable appearance. In addition it is difficult to store the thin metal stripping and insure that no wrinkles or creases are placed in the stripping thus rendering it unsuitable for future use. The use of the roofing piece 48 of the present invention as a rake cover 24 eliminates the undesirable features encountered in the use of metal stripping as outlined above.

Another advantage of the multipurpose roofing piece of the present invention, which is not apparent from the physical appearance of the roofing piece but is of considerable interest to manufacturers of composition roofing pieces, is that it will permit manufacturers to reduce inventory and storage requirements and make more efficient use of production line down time.

Prior composition hip and ridge covers could not be manufactured without shutting down the production line normally used to manufacture composition shingles. This "down time" is undesirable. To minimize down time, large quantities of such hip and ridge cover were produced in a single run, e.g., maybe a six months supply, and then stored. Thus, storage costs were significant. Because the hip and ridge cover of the present invention may be formed, during down time, from the very same piece used for edge and rake and starter pieces, such down time is used to maximum efficiency. The same piece serves multipe functions.

Figure 8:
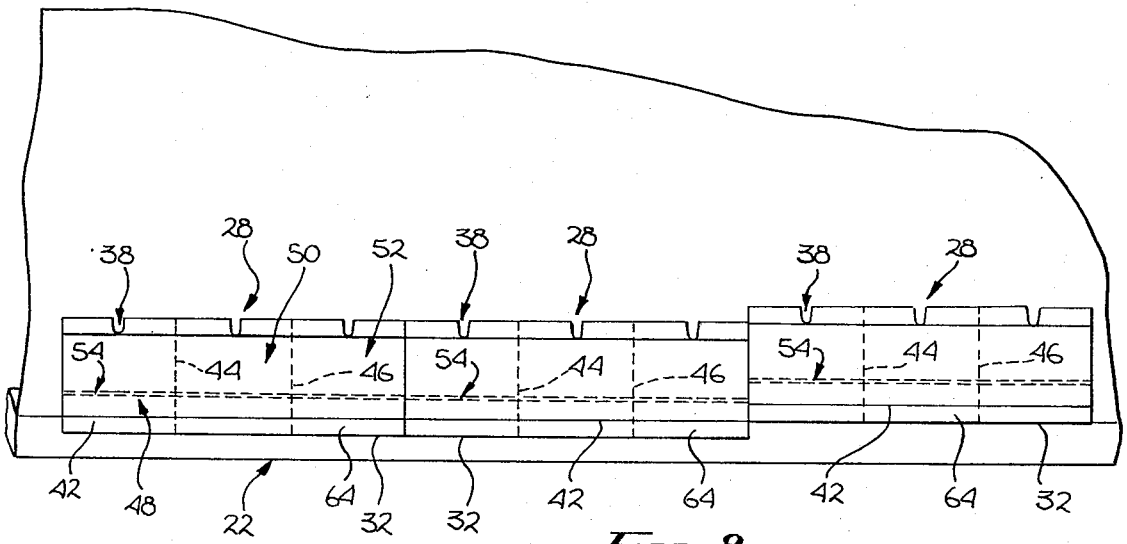
FIG. 8 shows the roofing piece of FIG. 3 functioning as a starter piece or edge piece.

FIG. 8 shows the use of the roofing piece 28 (See FIG. 3) as a combination edge cover and starter material. This "combination" mode is shown in the far left side and center portion of FIG. 8. At the far left, the roofing piece 28 has been broken into three separate smaller roofing pieces 48, 50 and 52 each of which has its second foldable portion 64 folded over the front edge 22 of the roof and each is placed to overlap the adjacent piece. The piece 28 can also be used as an edge piece without breaking into smaller pieces as shown in the center portion of FIG. 8. The use of the roofing piece 28 as a starter material only is shown in the far right portion of FIG. 8. When used in this mode the roofing piece 28 is not separated along the perforations 44 or 46 thus, the roofing piece 28 is laid in its entirety along the front edge 22 of a roof. When used as an edge covering the piece is folded along the second fold line 42 to allow the second foldable portion 64 to hang over the forward edge of the roof. When used as a starter material the roofing piece 28 is located on the roof such that the second edge 32 lies coincident with the front edge 22 of a roof. This serves as a first layer upon which are laid subsequent layers of roofing shingles thereby providing double coverage even at the forward edge 22 of the roof.

In each of the applications as illustrated above the adhesive material 54 serves to secure one layer of roofing material to that layer which lies below and thus increases the integrity of the roof against high winds, driven rain, sleet and snow and so forth and insures a longer life for the roof. The use of a notch 38 permits the easy folding of the small roof piece 48 when used as a ridge or hip cover 16. The use of a first fabric tape 58 and second fabric tape 60 insure that when the smaller roofing piece such as 48 is folded in cold weather, the first foldable portion 62 and second foldable portion 64 will not snap or sever from the main body of the roofing piece 48. Instead the fabric tapes will serve as hinge members to insure that the foldable portions remain secured to the body of the roofing piece 48.

There has thus been provided a roofing piece 28 as shown in FIG. 3, and shown in greater detail in FIGS. 4 and 5, the features of which permit the same roofing piece 28 to function as a hip or ridge cover 16, a rake cover 24, an edge cover 26 or as a starter material such as shown in FIG. 8. This multipurpose roofing piece overcomes the various disadvantages of the prior methods of covering edges and rakes of re-roofing jobs and provides for a more pleasing appearance of the re-roof edge. The use of the perforations 44 and 46 increases the versatility the roofing piece 28 and permits it to be divided into three equally size smaller roofing portions such as 48, 50 or 52 shown in FIG. 3 thereby allowing the roofing piece 28 to function as a hip and ridge cover 16. While portions of the above specification, and particularly FIGS. 2 and 7, make particular reference to use of the roofing piece in re-roofing applications, the invention also is suited to function as a new roof piece, i.e., in new construction, and can also be used to cover an old composition roof. The invention should not be interpreted as limited to covering old shake roof. While the foregoing has described the present invention in terms of the embodiment illustrated in FIGS. 1–8 it is recognized that various changes, modifications, additions, and substitutions of material may be made by those skilled in the art without departing from the spirit and scope of the present invention. It is intended that the present invention be limited in its scope only by the scope of the appended claims.

What is claimed is:

1. An asphalt composition roofing piece of generally rectangular shape comprising a layer of asphalt saturated felt having a layer of rock granules applied to one side thereof and having a first end, a second end, a first edge and a second edge and further comprising:

a first foldable portion integral with said roofing piece and coupled thereto by a first hinge means having a hinge axis parallel to said first edge;

a second foldable portion integral with said roofing piece and coupled thereto by a second hinge means having a hinge axis parallel to said second edge;

at least one line of decreased structural integrity extending from said first edge to said second edge and lying perpendicular thereto and dividing said roofing piece into a plurality of equally sized parts;

each equally sized part being provided with a notch extending from said first edge to approximately the hinge axis of said first hinge means and placed approximately at the midpoint of the first edge of each such equally sized part.

2. The roofing piece according to claim 1 wherein said first foldable portion is defined by that portion of said roofing piece lying between a first means for locating a fold and said first edge;

and said second foldable portion is defined by that portion of said roofing piece lying between a second means for locating a fold and said second edge;

said first means for locating a fold lying in parallel spaced apart relation to said first edge; and said second means for locating a fold lying in parallel spaced apart relation to said second edge.

3. The roofing piece according to claim 2 wherein said first and second means for locating a fold comprise a first crease and a second crease respectively.

4. The roofing piece according to claim 2 wherein at least one of said first and second means for locating a fold comprises a pair of closely spaced apart creases.

5. The roofing piece according to claim 1 wherein said first and said second hinge means each comprises a strip of fabric tape coupled to said roofing piece, whereby said first and second foldable portions may be folded without separating from said roofing piece.

6. The roofing piece according to claim 1 further comprising:

a strip of adhesive material applied along the length of said roofing piece over the layer of granules; and a non-sticky strip coupled to the other side of said roofing piece directly opposite said strip of adhesive so as to prevent said adhesive from contacting and adhering to an adjacent roofing piece when packed for shipment or storage.

7. The roofing piece according to claim 1 further comprising:

a region, adjacent said first edge and slightly wider than said first foldable portion, within which said layer of granules is darker in color than the remainder of said layer of granules.

* * * * *